US006191673B1

(12) United States Patent
Ogura et al.

(10) Patent No.: US 6,191,673 B1
(45) Date of Patent: Feb. 20, 2001

(54) CURRENT TRANSFORMER

(75) Inventors: Shinzou Ogura; Hikozo Morisita; Naoki Ochi; Kazuhiro Nakazaki, all of Tokyo; Chiharu Umeno, Hyogo, all of (JP)

(73) Assignee: Mitsubushi Denki Kabushiki Kaisha, Tokyo (JP)

( * ) Notice: Under 35 U.S.C. 154(b), the term of this patent shall be extended for 0 days.

(21) Appl. No.: 09/314,968

(22) Filed: May 20, 1999

(30) Foreign Application Priority Data

May 21, 1998 (JP) ..... 10-139812
May 10, 1999 (JP) ..... 11-127973

(51) Int. Cl.[7] ..... H01F 27/36

(52) U.S. Cl. ..... 336/84 R; 336/174; 336/175; 336/178; 336/84 C

(58) Field of Search ..... 336/84 R, 84 C, 336/84 M, 174, 175, 178; 324/442, 445

(56) References Cited

U.S. PATENT DOCUMENTS 3,030,573 * 4/1962 Yamashita et al. ..... 324/442
4,471,333 * 9/1984 Stephanides ..... 336/84 C
4,806,896 * 2/1989 Shikano et al. ..... 336/84 C
5,659,251 * 8/1997 Wakamatsu ..... 324/445
5,764,123 * 6/1998 Waters et al. ..... 336/84 R

FOREIGN PATENT DOCUMENTS 60-256067 * 12/1985 (JP) .
64-17414 1/1989 (JP) .
1206613 8/1989 (JP) .
2-151707 * 6/1990 (JP) .
3-131768 * 6/1991 (JP) .
7-220963 * 8/1995 (JP) .
7220963 8/1995 (JP) .

* cited by examiner

*Primary Examiner*—Lincoln Donovan
*Assistant Examiner*—Tuyen T. Nguyen
(74) *Attorney, Agent, or Firm*—Leydig, Voit & Mayer, Ltd.

(57) ABSTRACT

A current transformer includes transformer units combined into a bundle, each of the transformer units including an annular iron core surrounding a bus conductor and a secondary winding wound around the iron core for measuring an electric current flowing through the bus conductor, and a shield winding wound around the bundle of the transformer units. The secondary winding may be provided with an air gap in which no secondary winding is present, located at a portion of the current transformer in a direction of a resultant vector, perpendicular to a line connecting bus conductors neighboring the bus conductor to be measured and passing through the bus conductor to be measured. A second air gap may be provided at the position opposite the air gap of the transformer, relative to the bus conductor to be measured, and the shield winding may be divided into two parts at the air gap and opposite the air gap relative to the bus conductor to be measured.

6 Claims, 6 Drawing Sheets

CURRENT TRANSFORMER

BACKGROUND OF THE INVENTION

This invention relates to a current transformer for measuring an electric current flowing through three phase bus bar conductors.

FIG. 9 is a schematic illustration of a conventional current transformer disclosed in Japanese Patent No. 2600548 and FIG. 10 is a cross-sectional view taken along line A—A of the current transformer of FIG. 9. In the figures, reference numeral 1 is one of the three-phase bus bar conductors which is a line to be measured in terms of the electric current. 2*a* and 2*b* are iron cores for defining a magnetic path intersecting the bust conductor 1, and 3*a* and 3*b* are secondary windings wound on the iron cores 2*a* and 2*b* for measuring the electric current flowing through the bus conductor 1 to be measured. The secondary windings 3*a* and 3*b* are not illustrated in FIG. 9.

4*a* and 4*b* are shield windings, each of which comprises four coils having the equal number of windings wound on the iron cores 2*a* and 2*b* to extend over the equal circumferential distance of the iron core. The shield windings 4*a* and 4*b* respectively surround in intimate contact the current transformers 8*a* and 8*b* which are disposed in the direction of the longitudinal axis of the bus conductor 1. The shield windings 4*a* and 4*b* are for alleviating the influence of the electric current flowing through the neighboring bus conductors 6*a* and 6*b* on the electric current flowing through the secondary windings of the bus conductor 1. 5 is a connection line for connecting together the terminals of the same polarity of the shield winding 4.

6*a* are two of three-phase bus conductors, which are adjacent to the bus conductor 1 to be measured. 6*b* are conductors connecting the bus conductor 1 and the bus conductors 6*a* to each other for providing a neutral point, which is a junction between the bus conductor 1 and the bus conductors 6*b*. 8*a* and 8*b* are current transformers (8*a* and 8*b* are transformer units, which generally referred to as a transformer), which are composed of iron cores 2, 2*a* and 2*b*, secondary windings 3*a* and 3*b* and shield windings 4, 4*a* and 4*b*, respectively. L is a distance between the iron cores 2*a* and 2*b*.

The operation of this current transformer will now be described. In FIGS. 9 and 10, the electric currents flowing through the secondary windings 3*a* and 3*b* are proportional to the current flowing through the bus conductor 1 to be measured, so that the electric current flowing through the bus conductor 1 can be measured by the secondary windings 3*a* and 3*b*. The shield windings 4*a* and 4*b* are wound around the iron cores 2, 2*a* and 2*b*, respectively, divided into four along the circumference of the iron core and the same polarity of each coil is connected together by the connection line 5, so that the electric current flowing through the bus conductors 6*a* and 6*b* induces an electric current in the shield windings 4*a* and 4*b*, thereby reducing the magnetic flux penetrating into the iron cores 2, 2*a* and 2*b*. Also, it is possible to ensure that the magnetic flux generated by the induced current does not affect the current in the bus conductor 1 to be measured.

However, since there are two secondary windings and two shield windings between the iron cores 2*a* and 2*b*, generating a large amount of heat and since the heat dissipating surface area at this portion is small, the current transformer generates a large amount of heat.

Also, as for the current transformer 8*a* far from the bus conductor 6*b* constituting the neutral point, the mutual inductance between the bus conductor 6*b* and the shield winding 4*a* is small and the electric current induced in the shield current is small. On the other hand, as for the current transformer 8*b* close to the bus conductor 8*a*, the mutual inductance between the bus conductor 6*b* and the shield winding 4*b* is large and the current induced within the shield windings is large generating a large heat at the current transformer 8*b* close to the bus conductor 6*b*. Therefore, a problem has been posed that a material having a good heat resistivity and a winding having a large winding diameter must be used.

Also, when the distance L between the iron cores 2*a* and 2*b* is large, the magnetic flux from the bus conductors 6*a* can easily penetrate, so that a large current is induced in the shield windings 4*a* and 4*b*, generating a large heat in the transformer and the magnetic flux is apt to concentrate at the iron cores 2, 2*a* and 2*b*, posing a problem that the cross-sectional area of the iron core must be made large for achieving the precise current measurement of the bus conductor 1.

Further, the shield windings 4*a* and 4*b* are divided into the coil sections of an even number disposed around the transformer 8 and have the same polarity connected together, but since the mutual inductance between the respective divided coil sections and the bus conductors 6*a* and 6*b* are different, making the induced current imbalance, generating a local high temperature in the current transformer.

SUMMARY OF THE INVENTION

The chief object of the present invention is to provide a current transformer free from the above-discussed problems of the conventional current transformer.

Another object of the present invention is to provide a current transformer in which the heat generation from the shield winding is decreased and which can be made small in size and light in weight.

Another object of the present invention is to provide a current transformer in which the penetration of the magnetic flux into the iron core is decreased to allow a high accuracy measurement of the bus conductor.

A further object of the present invention is to provide a current transformer in which the inductance of the divided coils are made equal so that the local temperature elevation in the transformer may be suppressed.

With the above object in view, the current transformer of the present invention comprises a plurality of transformer units combined into a bundle, each of the transformer units including an annular iron core surrounding a bus conductor to be measured and a secondary winding wound around the iron core for measuring an electric current flowing through the bus conductor, and a shield winding wound around the bundle of the transformer units.

The bus conductor to be measured and a bus conductor neighboring to the bus conductor to be measured may be arranged in a common plane, and the current transformer unit is provided with a first air gap in which no secondary winding and no shield winding are wound at a portion of the current transformer unit located on a line extending perpendicularly to the plane from the bus conductor to be measured.

The current transformer of the present invention may comprise a plurality of bus conductors neighboring said bus conductor to be measured are arranged, and the transformer unit is provided with a first air gap in which no secondary winding and no shield winding are wound at a portion of the current transformer unit in a resultant vector direction of vectors perpendicular to a line connecting the bus conductors neighboring the bus conductor to be measured and passing through the bus conductor to be measured.

The shield winding is divided into two at the position of the air gap as well as at the position opposite to the first air gap relative to the bus conductor to be measured.

The current transformer may includes a second air gap in which no secondary winding and no shield winding are wound is provided at the position opposite to the first air gap of the transformer unit relative to the bus conductor to be measured.

The shield winding may be divided into two to have equal circumferential length.

BRIEF DESCRIPTION OF THE DRAWINGS

The present invention will become more readily apparent from the following detailed description of the preferred embodiments of the present invention taken in conjunction with the accompanying drawings, in which.

DESCRIPTION OF THE PREFERRED EMBODIMENTS

Embodiment 1

Figure 1:
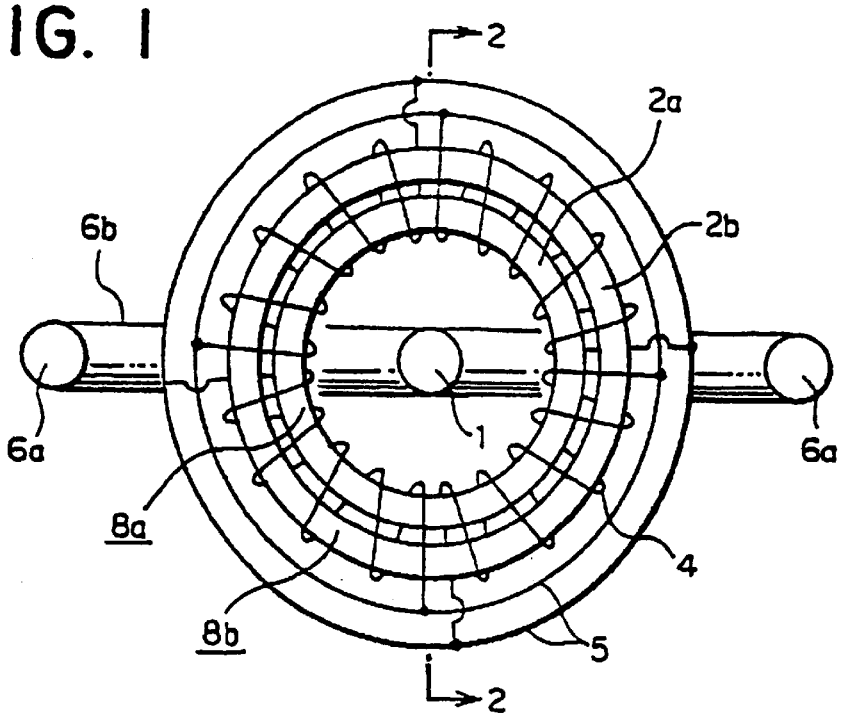
FIG. 1 is a plan view of the current transformer of the first embodiment of the present invention.
Figure 2:
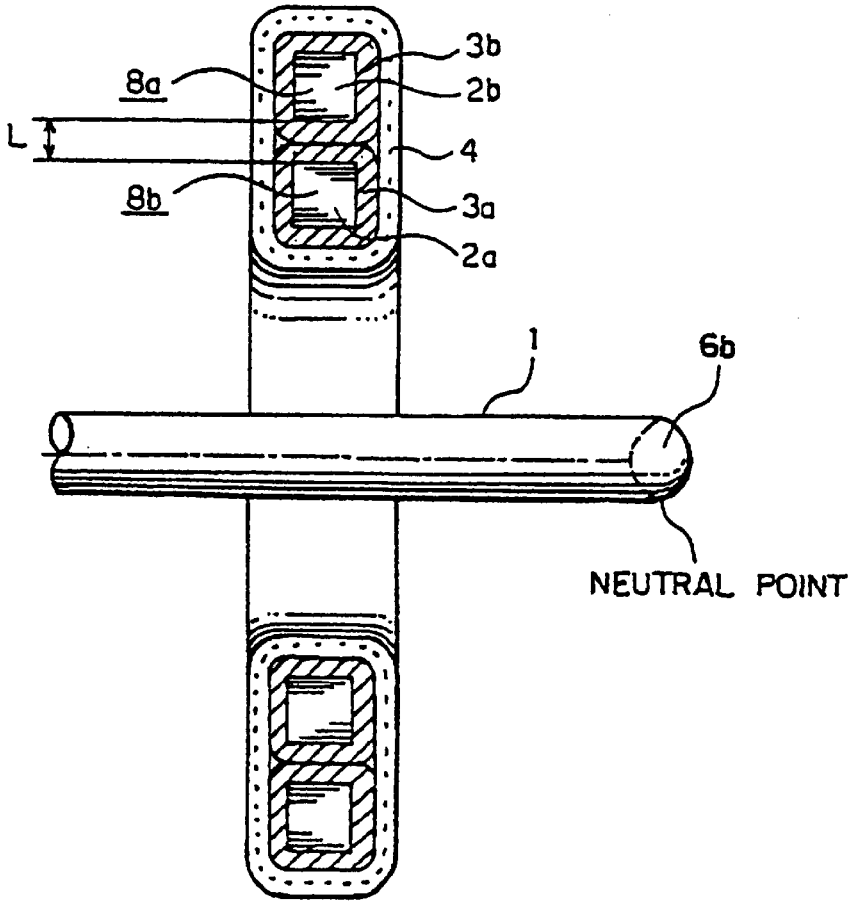
FIG. 2 is a sectional view taken along line A—A of FIG. 1.

FIG. 1 is a plan view illustrating the structure of a current transformer according to the first embodiment of the present invention. FIG. 2 is a sectional view taken along line A—A of FIG. 1.

In these figures, the reference characters 1 is one of three-phase bus conductors which is a bus conductor to be measured in terms of electric current, 2*a* and 2*b* are iron cores defining a magnetic path intersecting with the bus conductor 1 to be measured and having the respective, different diameters. 3*a* and 3*b* are secondary windings wound on the iron cores 2*a* and 2*b* for measuring the current flowing through the bus conductor 1 to be measured. The secondary windings 3*a* and 3*b* are not shown in FIG. 1.

4 is a shield winding which is a coil of the equal number of turns wound in the form of the circumferentially divided coils of an even number around the circumference of the iron cores around the iron cores 2*a* and 2*b*. The shield winding 4 is wound around two transformers 8*a* and 8*b* to bundle them into an arrangement in which they are disposed in contact with each other and on the same plane perpendicular to the axis of the bus conductor 1. The shield winding 4 is for alleviating the influence of the electric current flowing through the neighboring bus conductors 6*a* and 6*b* on the electric current flowing through the secondary windings 2*a* and 2*b*. 5 is a connection line for connecting the terminals of the same polarity of the shield winding 4.

6*a* is a bus conductor neighboring the bus conductor 1 to be measured and 6*b* is a bus conductor for defining a neutral point and for connecting the bus conductor 1 to be measured and the bus conductor 6*a* together. The neutral point is a point at which the bus conductor 1 to be measured and the bus conductor 6*b* are intersecting. 8*a* and 8*b* are transformer units (here, the transformer units 8*a* and 8*b* are generally referred to as a transformer) composed of the iron cores 2*a* and 2*b*, the secondary windings 3*a* and 3*b* and the shield winding 4. The transformer units 8*a* and 8*b* are arranged on a common circular plane of the iron core 2*a* and 2*b* and they are in direct contact with each other. The reason for the plurality of transformer units being provided is for the simultaneous outputting to the current measurement, the meter display, the controls, etc. L is the distance between the iron cores 2*a* and 2*b*.

The operation of the current transformer will now be described. Since the electrical current flowing through the secondary windings 3*a* and 3*b* are proportional to the measured current flowing through the bus conductor 1 to be measured, the current flowing through the bus conductor to be measured can be measured by the secondary windings 3*a* and 3*b*. The shield winding 4 is wound around the iron cores 2*a* and 2*b* along its circumference in a divided coil of an even number and the same polarity end of the respective coils are connected together through the connecting line 5, so that an electric current is induced by the current through the bus conductors 6*a* and 6*b* within the shield winding 4, whereby the magnetic flux penetrating into the iron cores 2*a* and 2*b* are reduced. Also, the magnetic flux generated by the induced current can be made not to influence the measured current of the bus conductor 1 to be measured.

According to the present invention, since a single shield winding is wound around two transformer units 8*a* and 8*b* to make them a bundle, only the secondary windings 3*a* and 3*b* are provided between the iron cores 2*a* and 2*b* contrary to the case where separate shield windings are provided about the respective current transformers, the heat generation at this portion can be decreased, allowing the temperature rise to be suppressed.

Also, as compared to the case where separate shield windings are provided for the respective transformers, the length of the shield winding is decreased and the resistance value of the shield winding is smaller, so that the heat generation at the shield winding can be decreased.

Also, there is no shield winding provided between the iron cores 2*a* and 2*b*, so that the distance L between the iron cores 2*a* and 2*b* is shortened and that the magnetic flux generated by the current flowing through the bus conductor 6*b* providing the neutral point is difficult to penetrate thereinto. Therefore, the cross-sectional areas of the iron cores 2*a* and 2*b* can be made small. Further, the installation length in the radial direction of the transformer can be made shortened, so that a tank of a smaller diameter can be used when it is desired to insert the transformer into the tank or the like.

Also, even when two current transformer units 8*a* and 8*b* are wound and bundled by a single shield winding 4, the reactance of the shield winding 4 is larger than the resistance when the number of turns of the shield winding 4 is large, so that the electric current induced in the shield winding 4 does not change and that the shielding effect is not degraded.

Embodiment 2

Figure 3:
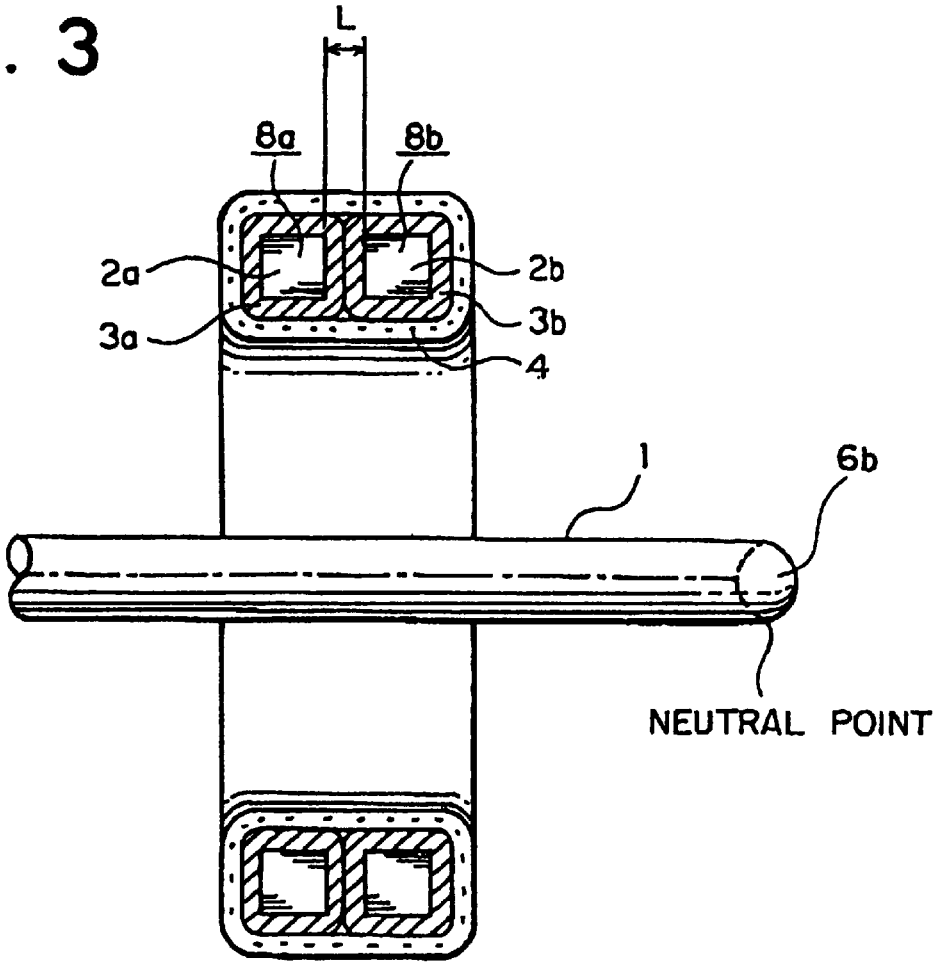
FIG. 3 is a sectional view of the current transformer of the second embodiment of the present invention.

FIG. 3 is a sectional view showing the structure of the current transformer of the second embodiment of the present invention. While two transformer units 8*a* and 8*b* are arranged in direct contact with each other and on the common plane perpendicular to the axis of the bus conductor 1 to be measured in the first embodiment, the transformer units 8*a* and 8*b* of this embodiment are arranged in parallel to the direction of axis of the bus conductor 6*b*. In other respects, the structure is similar to that of the first embodiment, so that the description will be omitted.

According to this embodiment, there is no shield winding provided between the iron cores 2*a* and 2*b*, so that the distance L between the iron cores 2*a* and 2*b* is shortened and that the magnetic flux generated by the current flowing through the bus conductor 6*a* is difficult to penetrate thereinto. Therefore, the cross-sectional areas of the iron cores 2*a* and 2*b* can be made small. Further, electric current flowing through the bus conductor 1 to be measured can be measured in a high precision.

Also, even when the current transformer 8 is located close to the neutral point, the concentration of the magnetic flux is low at the iron core 2*a* far from the neutral point although the magnetic flux concentrates at the iron core 2*b* close to the neutral point, the induction current induced in the shield winding 4 wound around the iron cores 2*a* and 2*b* is alleviated or decreased, enabling the heat generation to be low. Also, the axial direction installation length of the bus conductor 1 to be measured can be made short.

Also, even when two current transformer units 8*a* and 8*b* are wound and bundled by a single shield winding 4, the reactance of the shield winding 4 is larger than the resistance when the number of turns of the shield winding 4 is large, so that the electric current induced in the shield winding 4 does not change and that the shielding effect is not degraded.

Embodiment 3

Figure 4:
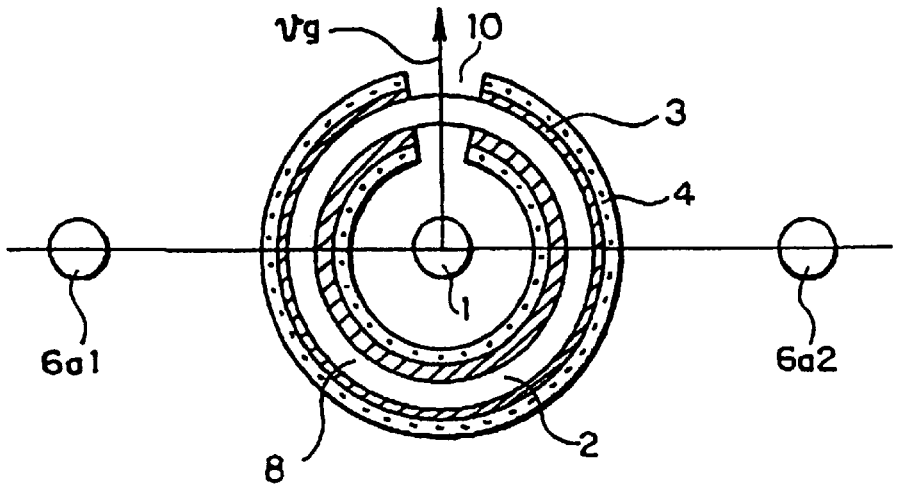
FIG. 4 is a sectional view of the current transformer of the third embodiment of the present invention.

FIG. 4 is a sectional view showing the structure of the current transformer of the third embodiment of the present invention, which corresponds to the section as viewed from the front side of FIG. 1. In the FIGS. 6*a*1 and 6*a*2 are bus conductors arranged in line with the bus conductor 1 to be measured. 10 is a first air gap in which the secondary winding 3 and the shield winding 4 are not wound for allowing the terminals of the secondary winding 3 to pass therethrough. Here, the air gap refers to a portion in which the secondary winding is not wound or a portion in which only two layers are provided for taking out the secondary winding when the secondary winding 3 has three winding layers. Also, the shield winding 4 to be wound thereon has also a portion in which the shield winding 4 is not wound at the portion for taking out the secondary winding 3 as in the case of the secondary winding 3. In other respects, the structure is similar to that illustrated in FIG. 1.

The first air gap 10 is provided at the portion of the transformer 8 on a vector vg perpendicular to the line connecting between the bus conductors 6*a*1 and 6*a*2 neighbor the bus conductor 1 to be measured and on a portion of the transformer 8 and at the portion most remote from the neighboring bus conductors 6*a*1 and 6*a*2.

Then, the operation of this current transformer 8 will now be described. The transformer 8 has the first air gap 10 at an overlapping portion at which the portion for taking out the input and output lines of the secondary winding 3 and the dividing portion of the shield winding 4, so that the insulating breakdown voltage between the input and output terminals of the secondary winding 3 is increased, enabling to prevent short-circuiting faults between the input and output terminals of the secondary winding 3 due to a large electric current.

At the air gap, the magnetic flux due to the electric current flowing through the bus conductors 6*a*1 and 6*a*2 can easily penetrate into the iron core. Therefore, according to this embodiment, the first air gap 10 is positioned at the portion most remote from the bus conductors 6*a*1 and 6*a*2, so that the concentration of the magnetic flux into the iron core 2 of the air gap portion can be alleviated, allowing a high accuracy measurement of the electric current flow in the bus conductor 1 to be measured.

Embodiment 4

Figure 5:
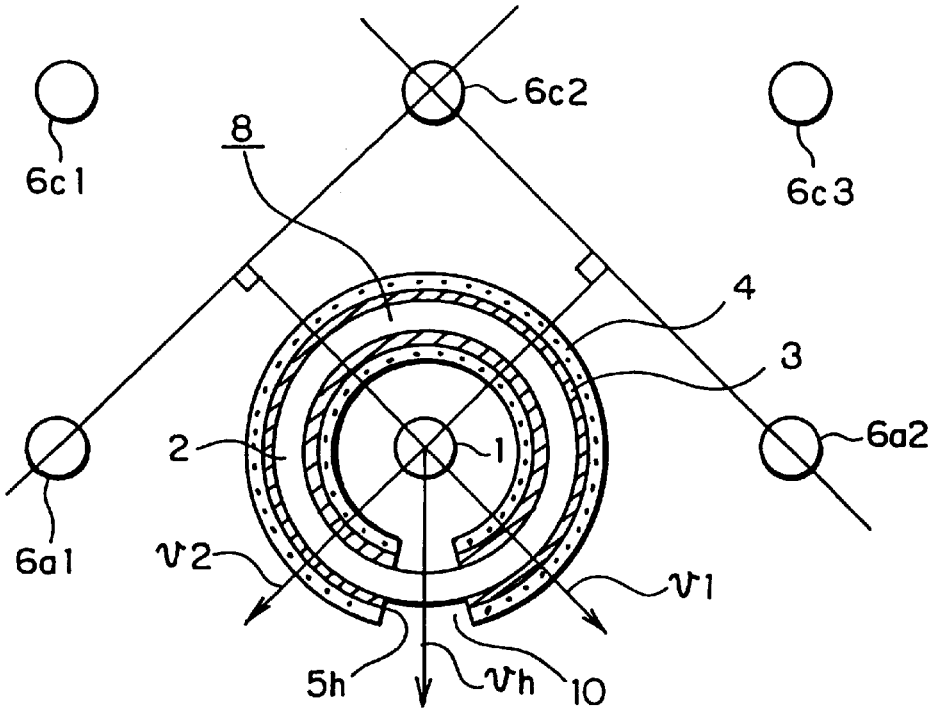
FIG. 5 is a sectional view of the current transformer of the fourth embodiment of the present invention.

FIG. 5 is a sectional view illustrating the construction of the current transformer of the fourth embodiment of the present invention. In the figure, 6*c*1, 6*c*2 and 6*c*3 are bus conductors which are arranged on the line parallel to the line connecting the bus conductor 1 and the bus conductor 6*a*1 and the bus conductor 6*a*2. Also, the bus conductor 6*c*2 is at the vertical position relative to the bus conductor 1 on the line connecting the bus conductor 1 to the bus conductor 6*a*1 and the bus conductor 6*a*2. The bus conductor 1 to be measured, the bus conductor 6*a*1 and the bus conductor 6*a*2 has an electric current flowing opposite to that of the bus conductor 6*c*1, the bus conductor 6*c*2 and the bus conductor 6*c*3. In other respects, the structure is similar to that shown in FIG. 4.

According to this embodiment, the first air gap 10 is provided at the portion of the transformer 8 on a resultant vector vh, of a vector v1 perpendicular to the line connecting the bus conductors 6*a*1 and 6*c*2, and passing through the bus conductor 1 to be measured and a vector v2, perpendicular to the line connecting the bus conductors 6*a*2 and 6*c*2, and passing through the bus conductor 1 to be measured. Thus, the first air gap 10 is disposed at the portion of the transformer 8 most remote from the bus conductor 6*c*2.

According to this embodiment, the first air gap 10 is provided at the portion most remotely separated from the bus conductors 6*a*1, 6*a*2 and 6*c*2, so that the concentration of the magnetic flux in the iron core 2 through the air gap portion can be alleviated, allowing a high accuracy measurement of the current flowing through the bus conductor 1.

Although the neighboring bus conductors are explained as being arranged in a line in the third and the fourth embodiments, the effect of the induced current due to the neighboring bus conductors can be decreased when the position of the air gap is determined by similar procedures even when the neighboring bus conductors are arranged at random.

Embodiment 5

Figure 6:
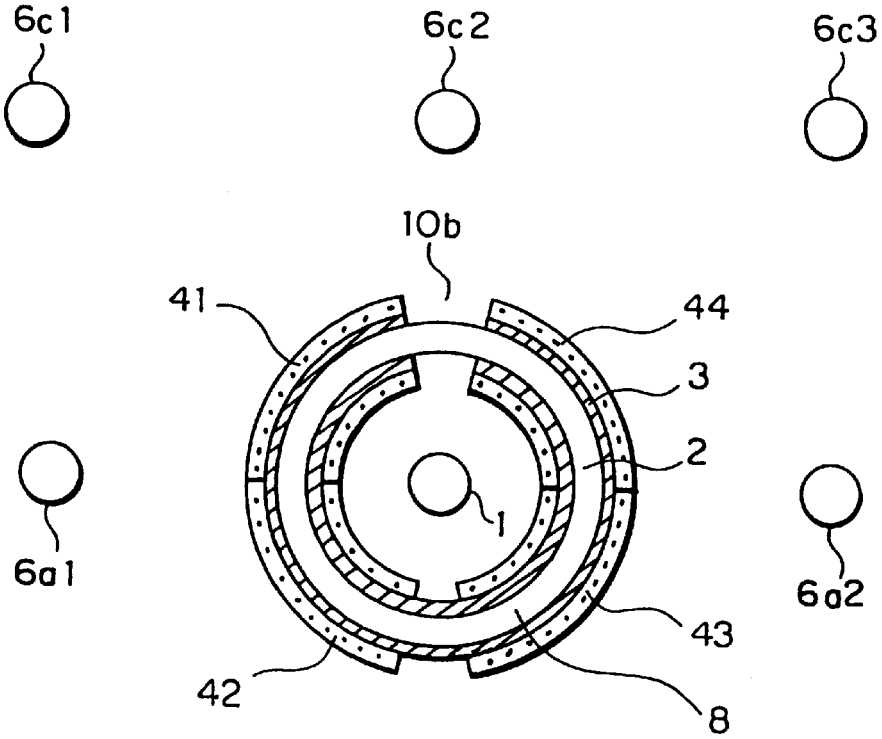
FIG. 6 is a sectional view of the current transformer of the fifth embodiment of the present invention.

FIG. 6 is a plan view showing the structure of the current transformer of the fifth embodiment of the present invention. In the figures, 41, 42, 43 and 44 are divided coils of the shield windings. 10*a* is a first air gap disposed in the transformer 8 for taking out the input and output lines of the secondary winding 2, and 10*b* is a second air gap at the opposite side of the first air gap 10*a* and has a length equal to that of the first air gap 10*a*. In other respects, the structure is similar to that of the embodiment illustrated in FIG. 5.

Then, the operation of this current transformer will now be described. A U-phase electric current flows through the bus conductor 6*a*1 and a W-phase electric current flows through the bus conductor 6*a*2, so that induced currents of equal magnitude flow in the positive direction through the divided coils 43 and 44 of the shield winding and induced currents of magnitude equal to those flowing through the divided coils 43 and 44 flow in the opposite direction through the divided coils 41 and 42, whereby the magnetic flux concentrated into the iron core 2 at the portion where the divided coil 43 and the divided coil 44 are adjacent to each other, as well as the portion where the divided coil 41 and the divided coil 42 are adjacent to each other, is decreased. On the other hand, three-phase current flows through the bus conductors, in which the -U-phase flows through the bus conductor 6*c*1, the -V-phase flows through the bus conductor 6*c*2 and the -W-phase flows through the bus conductor 6*c*3, so that induced currents of the positive direction flow through the divided coils 41 and 42 and that induced currents of the opposite direction flow through the divided coil 42 and 43, whereby the magnetic flux is concentrated on the iron core 2 located around the first air gap 10*a* and the second air gap 10*b*.

The density of the magnetic flux concentrated on the iron core 2 around the first air gap 10*a* and the second air gap 10*b* is smaller than the magnetic flux density of the magnetic flux concentrating on the iron core 2 at a portion where the divided coils 43 and the 44 of the shield winding are close to each other and a portion where the divided coils 41 and 42 are close to each other.

Therefore, as illustrated in FIG. 6, the second air gap 10*b* is disposed at the position opposite to the first air gap 10*a* to make the configuration of the respective divided coils of the shield winding symmetric so that the distances between divided coils of the shield winding are equal to each other. Therefore, while the length of the shield winding is made short and the self inductance is made high, the mutual inductance with respect to the bus conductors 6*a*1 and 6*a*2 are made higher, so that the electric current induced in the coil of each shield coil is high, alleviating the magnetic flux concentration on the iron core 2 around the position where the divided coil 43 and the divided coil 44 are close to each other and the position where the divided coil 41 and the divided coil 42 are close to each other. Therefore, magnetic saturation is less likely to occur and the measurement of the current of the bus conductor 1 can be achieved at a higher precision.

Embodiment 6

Figure 7:
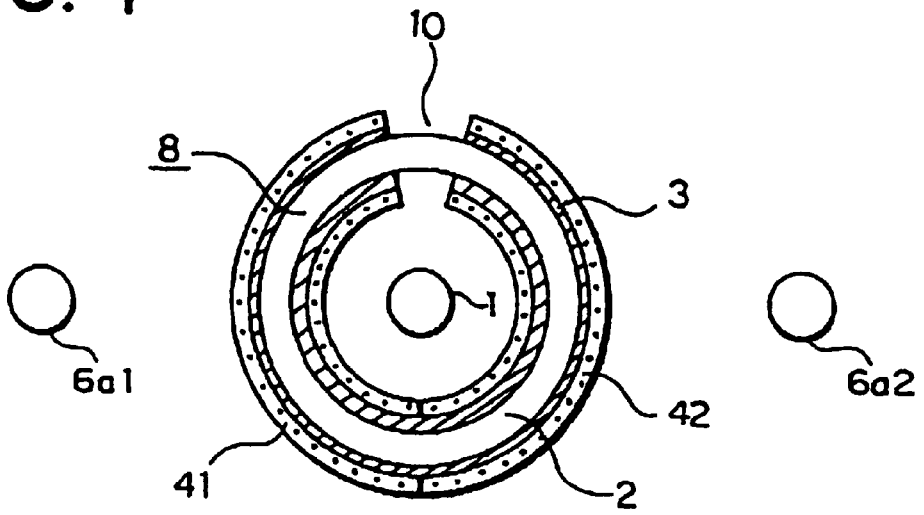
FIG. 7 is a sectional view of the current transformer of the sixth embodiment of the present invention.
Figure 9:
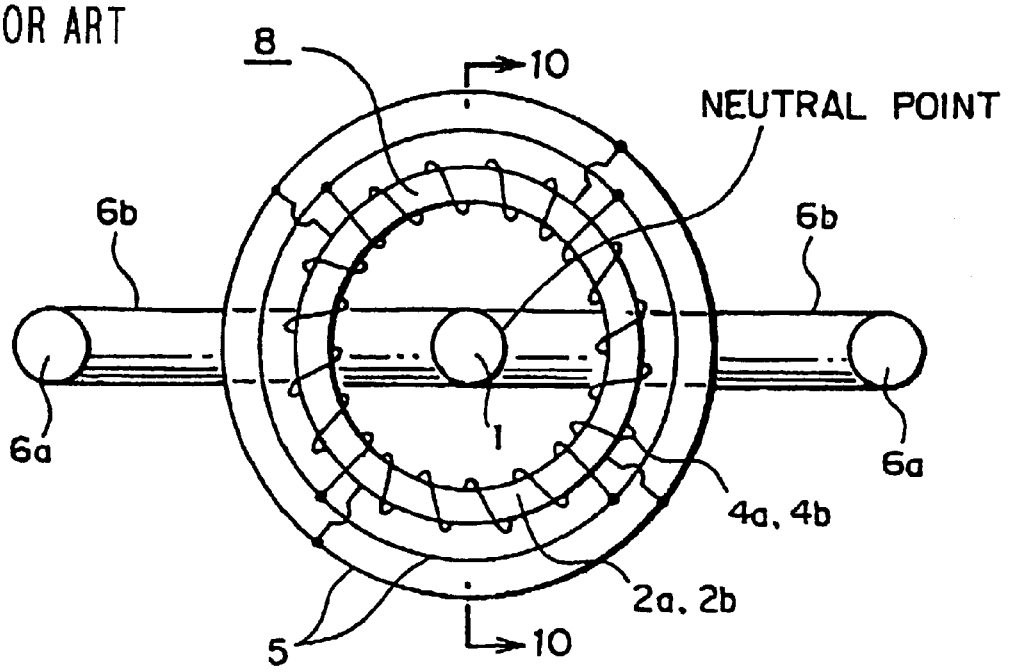
FIG. 9 PRIOR ART
FIG. 9 is a plan view showing a conventional current transformer.

FIG. 7 is a sectional view showing the structure of the current transformer of the sixth embodiment. In the figure, 41 and 42 are divided coils of the shield winding.

The operation of this current transformer will now be described. When a U-phase current flows through the bus conductor 6*a*1, a V-phase current flows through the bus conductor 1 to be measured and when a W-phase current flows through the bus conductor 6*a*2, the position at which the magnetic flux density of the iron core 2 is the highest is the position at which the iron core 2 is closest to the bus conductors 6*a*1 and 6*a*2. The measure for reducing the magnetic flux density is to arrange the central position of each of divided coils 41 and 42, as viewed in the circumferential direction, at the position at which the magnetic flux density is the highest, i.e., the position at which the iron core 2 is closest to the bus conductors 6*a*1 and 6*a*2.

Thus, the magnetic flux density in the iron core 2 is suppressed to a certain extent, the mutual inductance's with respect to the bus conductors 6*a*1 and 6*a*2 are lowered and the current induced in each divided coil 41 and 42 is reduced. Therefore, as compared to the current transformer explained in the fifth embodiment, although the self-inductance is decreased by an amount corresponding to the increased length of the divided coils, the mutual inductance is further decreased and the induction current is decreased to minimum. Therefore, the temperature rise in the shield winding 4 and the secondary winding 3 can be prevented.

Figure 8A:
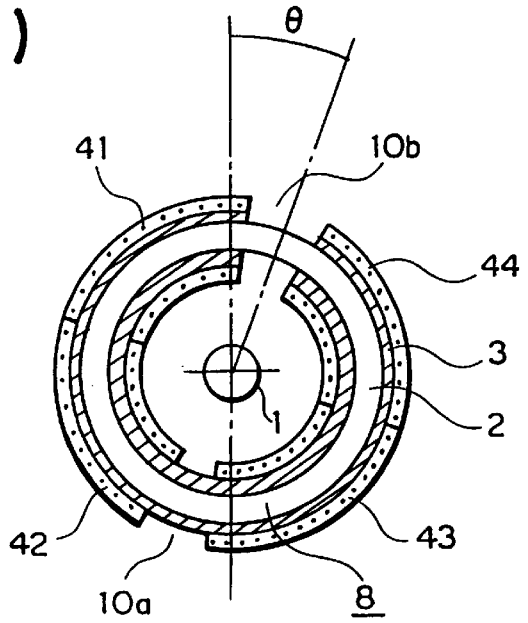
FIGS. 8(*a*) to 8(*c*) are views for explaining the current transformer of the sixth embodiment of the present invention.
Figure 8B:
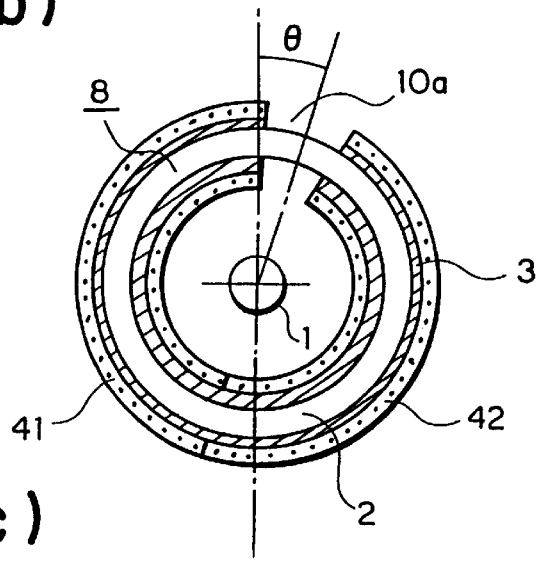
Figure 8C:
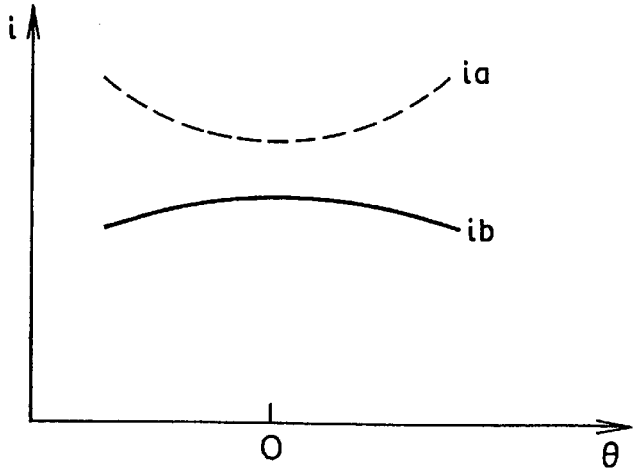
Figure 10:
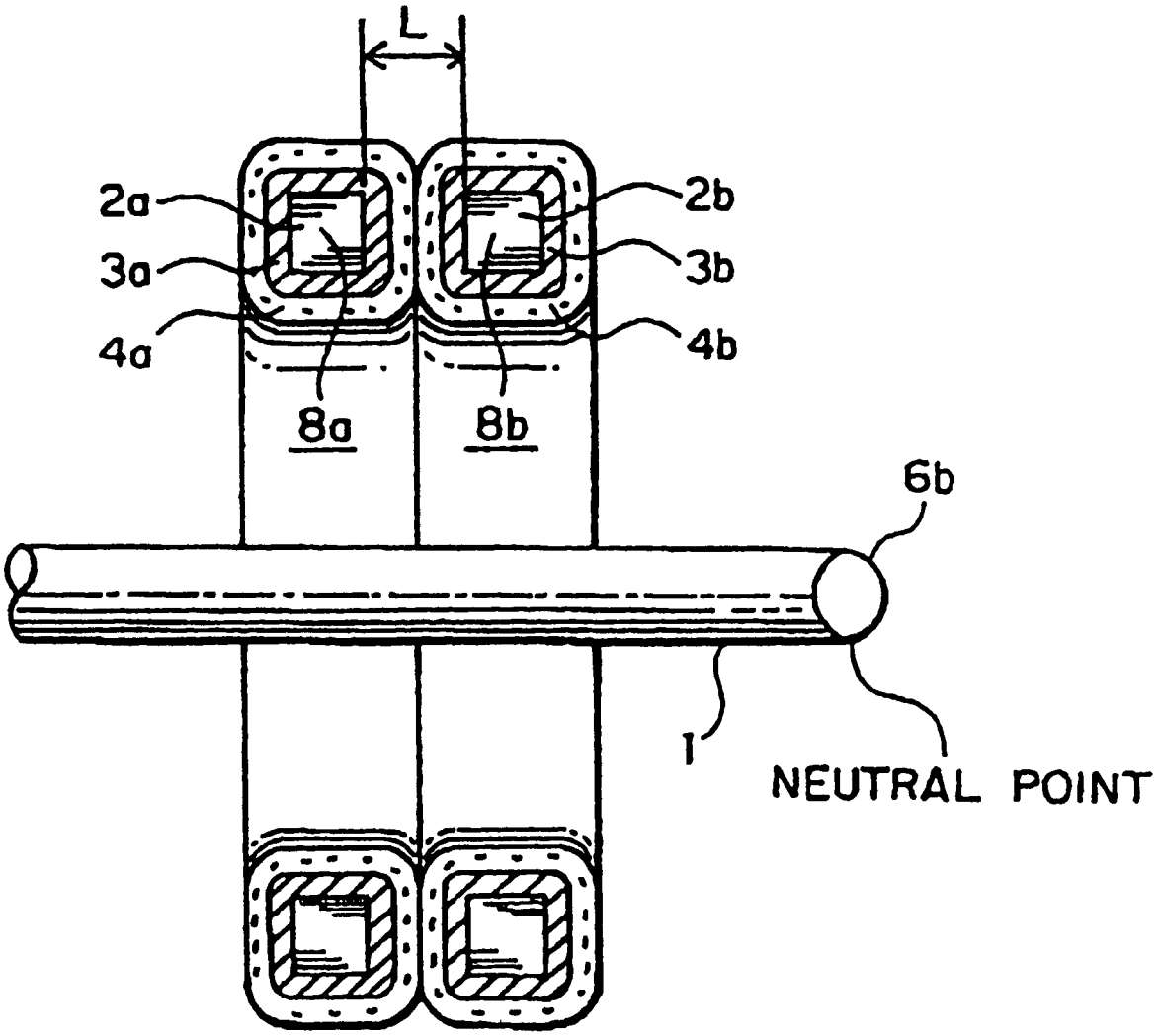
FIG. 10 PRIOR ART
FIG. 10 is a sectional view taken along line A—A of FIG. 9.

Also, as compared to the current transformer described as the fifth embodiment, the unbalance in the electric current is eliminated and the induction current is decreased to allow the overall temperature rise to be reduced. This will be explained in conjunction with FIGS. 8(*a*), 8(*b*) and 8(*c*). FIG. 8(*a*) is a view illustrating the state in which an installation deviation of an angle θ in the circumferential direction is generated in current transformer of the fifth embodiment, FIG. 8(*b*) is a view illustrating the state in which an installation deviation of an angle θ in the circumferential direction is generated in current transformer of the sixth embodiment and FIG. 8(*c*) is a view illustrating the relationship between the maximum current i flowing through the divided coil and the installation deviation angle θ, ia being an electric current flowing through the divided coils 42 and 44 of the current transformer of the fifth embodiment and ib being an electric current flowing through the divided coils 41 and 42 of the current transformer of the sixth embodiment.

When an installation deviation is generated, the mutual inductance changes with respect to the bus conductor becoming large in one divided coil and small in another divided coil. In the current transformer of the fifth embodiment, with the larger installation deviation angle θ, the mutual inductance of the divided coils 42 and 44 with respect to the bus conductor become larger and, on the other hand, the mutual inductance of the divided coils 41 and 43 become smaller. Therefore, as shown in FIG. 8(*c*), the electric current ia flowing through the divided coils 42 and 44 becomes larger as the installation deviation angle θ becomes large.

Contrary to this, in the current transformer of the sixth embodiment, the larger the installation deviation angle θ, the smaller the mutual inductance of the deviation coils 41 and 42 with respect to the bus conductor. Therefore, as shown in FIG. 8(*c*), the electric current ib flowing through the divided coils 41 and 42 becomes smaller as the installation deviation angle θ becomes large, enabling the temperature rise to be suppressed.

As has been described, according to invention as claimed in claim 1, a shield winding wound around the bundle of the transformer units is provided, so that the magnetic flux penetrating into the iron core can be decreased, allowing a high accuracy measurement of the current flowing through the bus conductor, and the heat generation at the shield winding is reduced, allowing the current transformer to be made small-sized and light in weight.

According to the invention as claimed in claim 2, the bus conductor to be measured and a bus conductor neighboring to the bus conductor to be measured is arranged in a common plane, and the current transformer unit is provided with a first air gap in which no secondary winding and no shield winding are wound at a portion of the current transformer unit located on a line extending perpendicularly to the plane from the bus conductor to be measured, so that the concentration of the magnetic flux into the iron core in the vicinity of the air gap portion can be alleviated thus a high accuracy measurement of the current in the bus conductor can be achieved, and it is possible to obtain a current transformer in which the effect of the induced current due to the bus conductor in the vicinity of the transformer is small.

According to the invention as claimed in claim 3, a plurality of bus conductors neighboring said bus conductor to be measured are arranged, and the transformer unit is provided with a first air gap in which no secondary winding and no shield winding are wound at a portion of the current transformer unit in a resultant vector direction of vectors perpendicular to a line connecting the bus conductors neighboring the bus conductor to be measured and passing through the bus conductor to be measured. Therefore, concentration of the magnetic flux into the iron core in the vicinity of the air gap portion can be alleviated thus a high accuracy measurement of the current in the bus conductor can be achieved, and it is possible to obtain a current transformer in which the effect of the induced current due to the bus conductor in the vicinity of the transformer is small.

According to the invention as claimed in claim 4, the shield winding is divided into two at the position opposite to the first air gap relative to the bus conductor to be measured, so that there is no unbalance in the induction current flowing through the divided coils and a temperature rise in the transformer is prevented.

According to the invention as claimed in claim 5 or 6, a second air gap in which no secondary winding and no shield winding are wound is provided at the position opposite to the first air gap of the transformer unit relative to the bus conductor to be measured, so that the electric current induced into the respective coils of the shield winding is large and the magnetic flux penetrating into the iron core can be reduced, whereby the magnetic saturation cannot easily take place, allowing to obtain a current transformer in which a high accuracy measurement of the current in the bus conductor.

According to the invention as claimed in claim 7 or 8, the shield winding is divided into two to have equal circumferential length, so that there is no unbalance in the induction current flowing through the divided coils and the temperature rise can be prevented.

What is claimed is:

1. A current transformer for measuring current flowing in a first bus conductor of a multi-phase electrical apparatus including multiple bus conductors, the current transformer comprising:

a plurality of current transformer units combined into a bundle, each of said transformer units directly contacting another of said transformer units within said bundle and including an annular iron core for surrounding a first bus conductor through which an electrical current to be measured flows; and a secondary winding wound around said annular iron core for measuring the electrical current flowing through the first bus conductor; and a shield winding wound around an outside of said bundle of said current transformer units, wherein the first bus conductor and another of the bus conductors of the multiple bus conductors are arranged in a common plane, and at least one of said current transformer units includes a first air gap, where no secondary winding and no shield winding are present, at a portion of said current transformer unit symmetrically located relative to a line perpendicular to the common plane.

2. The current transformer as claimed in claim 1, including a second air gap, where no shield winding is present, the second air gap being located opposite the first air gap with respect to the first bus conductor.

3. The current transformer as claimed in claim 2, wherein said shield winding is divided in two parts having equal circumferential lengths.

4. A current transformer for measuring current flowing in a first bus conductor of a multi-phase electrical apparatus including multiple bus conductors, the current transformer comprising:

a plurality of current transformer units combined into a bundle, each of said transformer units directly contacting another of said transformer units within said bundle and including an annular iron core for surrounding a first bus conductor through which an electrical current to be measured flows; and a secondary winding wound around said annular iron core for measuring the electrical current flowing through the first bus conductor; and a shield winding wound around an outside of said bundle of said current transformer units, wherein bus conductors of the multiple bus conductors, other than the first bus conductor, are disposed proximate the first bus conductor, and at least one of said current transformer units includes a first air gap, where no secondary winding and no shield winding are present, at a portion of said current transformer unit farthest from the bus conductors proximate the first bus conductor.

5. The current transformer as claimed in claim 4, including a second air gap, where no shield winding is present, the second air gap being located opposite the first air gap with respect to the first bus conductor.

6. The current transformer as claimed in claim 5, wherein said shield winding is divided in two parts having equal circumferential lengths.

* * * * *